US005996833A

United States Patent [19]

Lencioni et al.

[11] Patent Number: 5,996,833

[45] Date of Patent: Dec. 7, 1999

[54] TAMPER EVIDENT DUST COVER FOR A DRUM BUNG

[75] Inventors: Jeffrey H. Lencioni, St. Charles, Ill.; James P. Stevens, Castleton, N.Y.

[73] Assignee: Sonoco Development, Inc., Hartsville, S.C.

[21] Appl. No.: 08/964,922

[22] Filed: Nov. 5, 1997

[51] Int. Cl.[6] ..... B65D 51/20

[52] U.S. Cl. ..... 220/257; 220/270; 215/251

[58] Field of Search ..... 215/251, 254, 215/255, 277, 250, 252, 256; 220/257, 214, 270, 276, 601; 217/114

[56] References Cited

U.S. PATENT DOCUMENTS

| | | | |
|---|---|---|---|
| 1,982,145 | 11/1934 | Shera | 220/257 |
| 2,760,671 | 8/1956 | Parish, Jr. | 220/257 |
| 3,131,827 | 5/1964 | Wheaton | 220/257 |
| 3,357,592 | 12/1967 | Kusserow | 217/114 X |
| 3,452,894 | 7/1969 | Hendrickson et al. . | |
| 3,471,058 | 10/1969 | Latham et al. . | |
| 3,474,930 | 10/1969 | Lerner . | |
| 3,589,551 | 6/1971 | Haggbom . | |
| 3,684,124 | 8/1972 | Song . | |
| 3,715,063 | 2/1973 | Susuki et al. . | |
| 3,811,606 | 5/1974 | Higgins . | |
| 3,972,453 | 8/1976 | Kapples . | |
| 3,987,929 | 10/1976 | Mineo | 220/257 |
| 4,164,304 | 8/1979 | Roberson | 220/257 X |
| 4,376,493 | 3/1983 | Gall . | |
| 4,493,432 | 1/1985 | Smith . | |
| 4,501,371 | 2/1985 | Smalley | 220/257 X |
| 4,520,942 | 6/1985 | Dwinell | 215/251 X |
| 4,574,974 | 3/1986 | von Holdt . | |
| 4,579,257 | 4/1986 | Brandlein . | |
| 4,691,834 | 9/1987 | Bullock, III . | |
| 4,718,571 | 1/1988 | Bordner . | |
| 4,747,511 | 5/1988 | Dutt et al. . | |
| 4,821,913 | 4/1989 | Hidding . | |
| 4,865,233 | 9/1989 | Kain . | |
| 4,881,656 | 11/1989 | Chumley et al. . | |
| 5,002,198 | 3/1991 | Smith . | |
| 5,062,552 | 11/1991 | Heubel . | |
| 5,065,883 | 11/1991 | Udell | 220/257 X |
| 5,224,616 | 7/1993 | Crisci . | |
| 5,246,124 | 9/1993 | Battegazzore . | |
| 5,271,517 | 12/1993 | Bowers . | |
| 5,284,265 | 2/1994 | Crisci . | |
| 5,303,839 | 4/1994 | Blumenschein . | |
| 5,452,818 | 9/1995 | Yost . | |
| 5,540,342 | 7/1996 | Rathbun | 215/252 X |

*Primary Examiner*—Stephen K. Cronin
*Assistant Examiner*—Nathan Newhouse
*Attorney, Agent, or Firm*—Seidel, Gonda, Lavorgna & Monaco, P.C.

[57] ABSTRACT

A tamper evident dust cover for a drum bung is provided. The cover includes a cap portion and a sidewall portion extending downwardly from the edge of the cap portion. The cap portion has a pair of frangible lines which extend to its edges. The sidewall portion has an inner and outer surface, and a pair of frangible lines on one surface which communicate with the frangible lines on the cap portion. A locking ring is integrally formed with and extending downwardly from the sidewall portion. The locking ring is adapted to hinge at its juncture with the sidewall portion between two positions. In the first position, the locking ring is positioned downwardly and inwardly below the hollow area formed by the cap and the sidewall. When the locking ring is in the second position, it is positioned upwardly and inwardly into the hollow area of the cover. In the second position, the locking ring is capable of engaging the lip of a drum bung to prevent removal of the cover A pull tab extends outwardly from the sidewall. When the pull tab is pulled, part of the sidewall portion and the cap portion tear from the cover along the frangible lines.

12 Claims, 2 Drawing Sheets

FIG.1
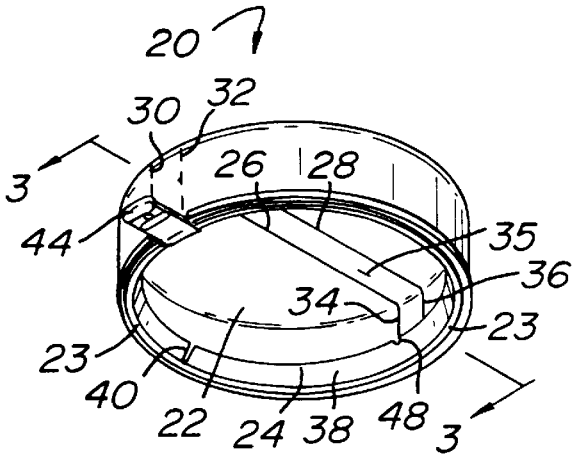
FIG.2
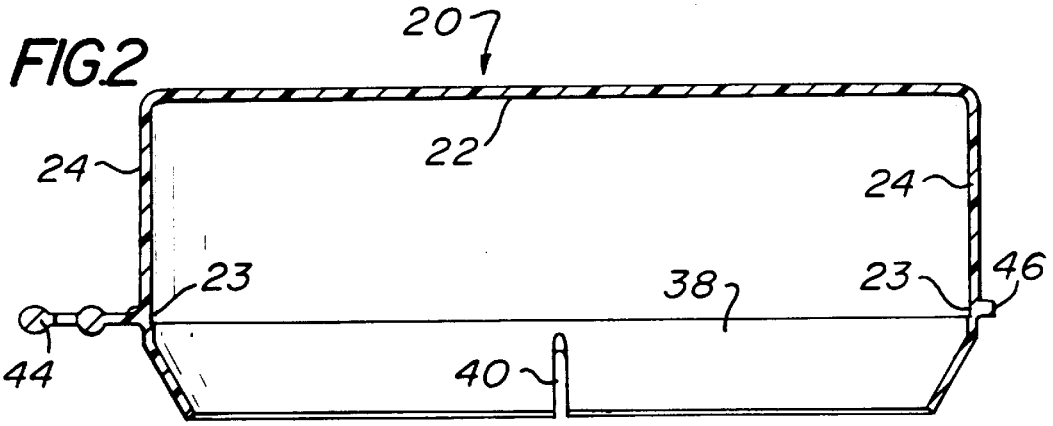
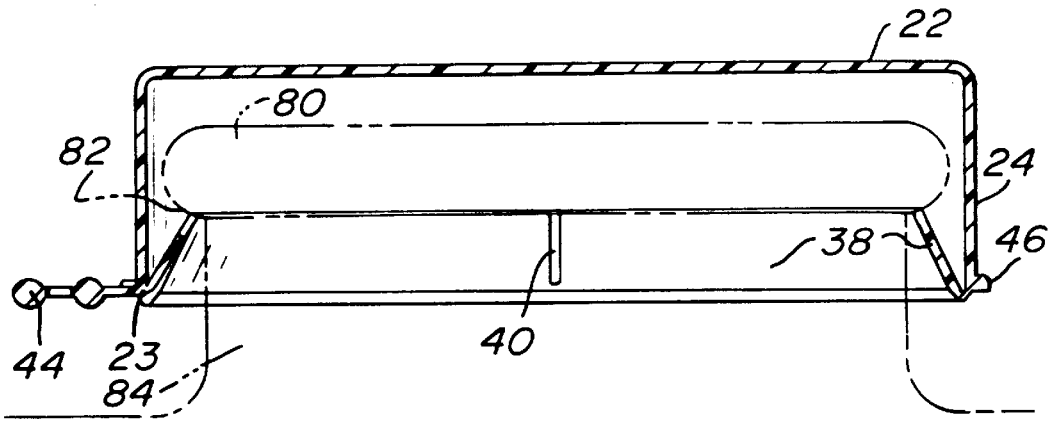
FIG.3

TAMPER EVIDENT DUST COVER FOR A DRUM BUNG

FIELD OF THE INVENTION

The present invention relates to a dust cover for a drum bung. More particularly, the invention relates to a tamper evidencing cover which is removable by pulling a tab which tears a strip off of the cover and divides the cover into two portions for removal from the bung.

BACKGROUND OF THE INVENTION

Vessels or drums are used commercially to store and dispense various substances. An opening is provided in the vessel or its lid to allow the vessel to be filled into and to dispense the contents of the vessel. The vessel opening is typically sealed with a removable bung or cap. The bung is typically threaded into the opening and forms a seal to prevent the contents from escaping from the vessel.

In order to provide an indication of prior access to the contents of a vessel, a tamper evident cover may be placed over the bung. Certain existing covers use tear strips which are positioned along a skirt portion of the cover in order to remove the cover. A locking ring mounted on the inner surface of the skirt, on or below the tear strip, is directed radially inwardly and engages the lip of the bung to prevent removal of the cover. When the tear strip is torn, the cover may be removed from the bung. A torn tear strip evidences prior removal of the cover and possible tampering with the contents of the vessel.

SUMMARY OF THE INVENTION

The present invention relates to a tamper evident dust cover for a drum bung. The cover includes a cap portion and a sidewall portion extending downwardly from the peripheral edge of the cap. A pair of frangible lines extend across the surface of the cap to the edges thereof. The sidewall portion also has a pair of frangible lines on one surface. The frangible lines on the sidewall portion communicate with the frangible lines of the cap portion.

A frusto-conical locking ring extends from the sidewall opposite of the cap portion. The locking ring is adapted to hinge at its juncture with the sidewall such that the ring extends upwardly and inwardly into the hollow area formed by the cap and the sidewall. When the locking ring is positioned in the this position, it engages the underside of the lip of the bung. The ring is also prevented from rotating inwardly by the opening formed within the drum. Thus, the ring prevents removal of the cover from the bung.

A pull tab extends outwardly from the sidewall and communicates with the portion of the sidewall defined between the frangible lines. When the tab is pulled, part of the sidewall portion tears from the remainder of the cover along the frangible lines. As the pulling continues the frangible lines on the cap portion may also be torn, dividing the cover. Once the strip is torn, the cover may be separated and then removed from the bung.

BRIEF DESCRIPTION OF THE DRAWINGS

For the purpose of illustrating the invention, there are shown in the drawings forms which are presently preferred; it being understood, however, that this invention is not limited to the precise arrangements and instrumentalities shown.

FIG. 1 is in isometric view of a drum bung dust cover as contemplated by the present invention.

FIG. 2 is a cross sectional view of the dust cover of the present invention with the locking ring in a first position.

FIG. 3 is a second cross sectional view of the dust cover of the present invention with the locking ring in a second position and as taken along line 3—3 in FIG. 1.

DETAILED DESCRIPTION OF THE DRAWINGS

Figure 4:
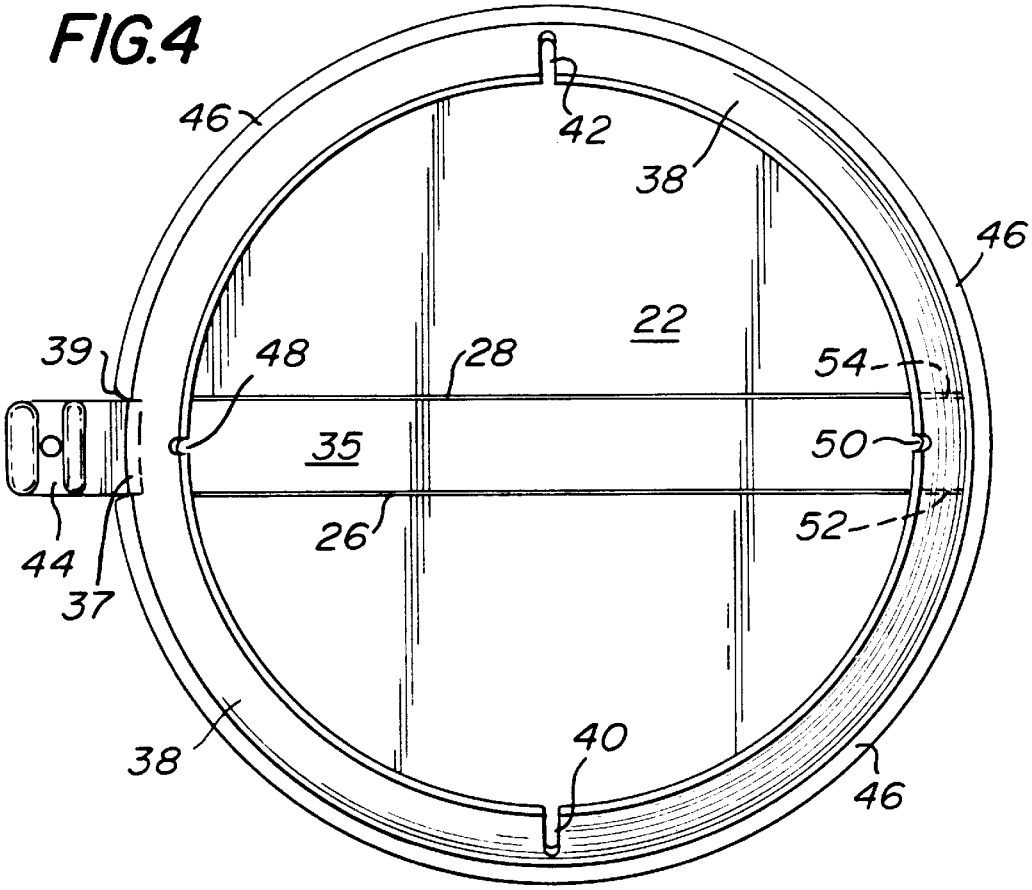
FIG. 4 is a bottom plan view of the dust cover of the present invention.

In the drawings, where like numerals identify like elements, there is shown a dust cover in accordance with the present invention which is generally identified by the numeral 20. In FIG. 1, the cover 20 is shown in perspective from below. The cover 20 includes a cap portion 22 and a sidewall portion 24 integrally formed with and extending downwardly from the peripheral edge of the cap portion 22 to a bottom edge 23. The cap portion 22 can be any shape, though a substantially circular cap 22 is preferable. The sidewall portion 24 may also be any shape, though annular is preferable.

As shown in FIG. 1 the bottom surface of the cap portion 22 has a pair of frangible lines 26 and 28 which extend to the edges thereof. On the inner surface of the sidewall portion 24, there is a first pair of frangible lines 30 and 32, illustrated in phantom, which communicate with the lines 26, 28 on the cap 22. Preferably, the sidewall lines 30, 32 extend to the bottom edge 23 of the sidewall portion 24. A second pair of frangible lines 34 and 36 may also be provided on the inner surface of the sidewall portion 24, opposite of the first sidewall lines 30, 32. The second sidewall lines 34, 36 also communicate with the lines 26, 28 on the cap portion 22. The second set of frangible lines 34, 36 are not required to extend to the bottom edge of the sidewall portion 24.

The frangible lines 26, 28, 30, 32, 34, 36 are contemplated to be molded grooves within the inside surfaces of the cap and sidewall portions. Alternatively, the lines may be scored into the surfaces or may take the form of perforations, holes, or other weaknesses within the molded plastic.

As illustrated in FIG. 2, a frusto-conical locking ring 38 extends from the bottom edge 23 of the sidewall portion 24, The extension of the locking ring below the hollow area defined by the cap 22 and sidewall 24 of the cover 20 is (in its molded position) downwardly and inwardly. The locking ring 38 is adapted to hinge at its juncture with the bottom edge 23 of the sidewall 24. The hinge may be, but is not limited to, a living hinge which is formed by a reduced cross section in the molded plastic at the juncture with the sidewall 24.

As illustrated in FIG. 3, the locking ring 38 may be hinged to a second position which is upward and inward into the hollow area defined by the cap 22 and the sidewall 24. When the locking ring 38 is folded to this second position, it engages the underside of the lip 82 of a drum bung 80 (shown in phantom). The locking ring also engages the neck 86 of the opening formed on the drum 84 (also shown in phantom). In this second position, the cover cannot be removed from the bung. An upward lifting force on the cover is countered by the engagement of the locking ring with the lip of the bung. The natural hinging action of the locking ring tapers it radially inwardly. The locking ring is not capable of rotating to its first position. Rather, the projection of the drum opening maintains the ring in its engagement position below the bung.

FIG. 4 shows the bottom of the cover 20 in its molded position. The locking ring 38 is provided with notches 40 and 42 to allow the ring 38 to flex between its first and second positions. Alternatively, the locking ring 38 may have holes, grooves, or the like, instead of notches 40 and 42. Minor notches 48 and 50 are also provided to facilitate movement of the locking ring 38 between its two positions. Any number of notches and/or minor notches may be provided in the locking ring 38. Also, frangible lines 52 and 54 may be provided on the locking ring 38. These ring lines 52, 54 communicate with the frangible lines 34, 36 (not shown in FIG. 4) on the sidewall portion 24 of the cover.

As also illustrated in FIG. 4, a bead 46 is provided on the bottom edge 23 of the sidewall 24. adjacent its joinder with the locking ring 38. The bead 46 projects outwardly and provides rigidity to the cover 20. A pull tab 44 is also provided on one side of the cover 20. The pull tab extends outwardly from the sidewall portion 24. An opening 37 is provided below the pull tab 44 and forms a gap in the locking ring 38. Alternatively, a frangible line may be located below the pull tab 44 on the sidewall or on the locking ring. As illustrated, the pull tab 44 is generally planer with at least a portion of the bead 46 (see FIGS. 2 and 3). Preferably, notches 39 are provided on opposite sides of the pull tab 44 to separate the bead 46 therefrom.

Figure 5:
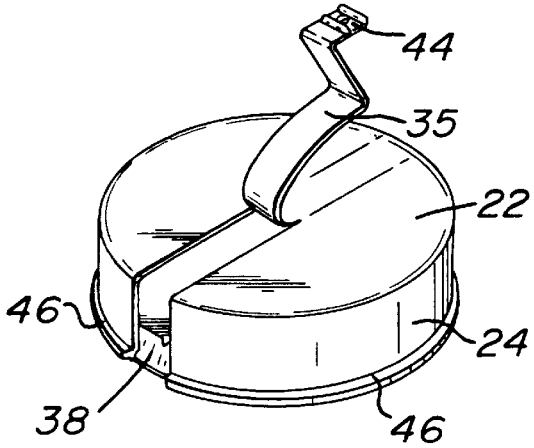
FIG. 5 is an isometric view of the dust cover of the present invention with the tamper evident strip portion being partially torn.

The pull tab 44 may be any shape. The function of the pull tab 44 is to provide a grip to start a fracture of the sidewall along the frangible lines 30, 32. Pulling the tab 44 initiates the tearing of strip 35, which is formed between the frangible lines on the sidewall 24 and the cap portions 22. As shown in FIG. 5, when the pull tab 44 is pulled, the strip 35 is torn from the dust cover 20 along the frangible lines and the cover is divided into two portions. The two portions can then be separated so that the locking ring 38 is disengaged from the bung 80 and the cover 20 can be removed. Once the strip 35 is torn, it remains at least partially detached from the remainder of the cover 20, thus evidencing at least an attempt at removal and possible tampering.

The present invention may be embodied in other specific forms without departing from the spirit or essential attributes thereof and, accordingly, reference should be made to the appended claims, rather than to the foregoing specification, as indicating the scope of the invention.

What is claimed is:

1. A cover for engaging a drum bung, comprising:

a cap portion having a top surface and a bottom surface and a perimeter edge defining the surfaces, a pair of frangible lines provided on the bottom surface and extending to opposing points of the perimeter edge;

a sidewall portion integrally formed with and extending downwardly from the bottom surface of the cap portion, the sidewall portion having a bottom edge and an inner surface and a first and a second pair of frangible lines on opposing portions of the inner surface, one pair of frangible lines communicating with each end of the frangible lines on the cap portion at the opposing points of the perimeter edge;

a locking ring integrally formed with and extending from the bottom edge of the sidewall portion, the locking ring adapted to hinge at its juncture with the sidewall portion from a first position to a second position, the second position being upward and inward of the bottom edge of the sidewall, the locking ring including a pair of frangible lines communicating with the first pair of sidewall frangible lines and extending to an edge of the locking ring; and a pull tab extending outwardly from the sidewall portion and communicating with the area of the sidewall portion that is between the first pair of sidewall frangible lines, such that, when the pull tab is pulled, part of the sidewall portion and then the cap portion may be torn form the cover along the frangible lines thereon.

2. The cover according to claim 1, wherein the sidewall portion is annular.

3. The cover according to claim 1, further comprising a pair of grooves of the sidewall portion extending to the bottom edge of the sidewall portion.

4. The cover according to claim 1, wherein the frangible lines are grooves.

5. The cover according to claim 1, wherein the cap portion is substantially circular.

6. The cover according to claim 1, wherein the locking ring includes at least one notch.

7. The cover according to claim 1, further comprising a bead projecting outwardly from the bottom edge of the sidewall portion.

8. The cover according to claim 1, wherein the pull tab extends outwardly from the bottom edge of the sidewall portion and wherein an opening is provided in the locking ring below the pull tab separating the pull tab from the locking ring.

9. The cover according to claim 1, further comprising an opening below the pull tab within the locking ring which separates the pull tab from the ring.

10. A cover for engaging a drum bung presenting a lip, comprising:

a hollow cap portion having a top and a sidewall, the sidewall extending from the top and defining an open area therebetween;

a pair of frangible lines extending up a first portion of the sidewall, across the top, and down a second portion of the sidewall opposing the first portion;

a locking ring extending from the sidewall, the locking ring foldable at its juncture with the sidewall from a first position, extending downward and inward from the open area, to a second position, extending upward and inward into the open area, the locking ring including a pair of frangible lines extending from the frangible lines of the second portion of the sidewall; and a pull tab extending outwardly from the first portion of the sidewall from a position between the frangible lines.

11. The cover according to claim 10, wherein the sidewall is annular.

12. The cover according to claim 10, wherein the locking ring has at least one notch to assist in the movement from the first position to the second position.

* * * * *

UNITED STATES PATENT AND TRADEMARK OFFICE
CERTIFICATE OF CORRECTION

Patent No.: 5,996,833

Dated: December 7, 1999

Inventor(s): Lencioni et al.

It is certified that error appears in the above-identified patent and that said Letters Patent is hereby corrected as shown below.

[75] Inventors: Jeffrey J. Lencioni, St. Charles, Ill.;
James P. Stevens, Castleton, N.Y.

Signed and Sealed this

Fourteenth Day of November, 2000

*Attest:*

Q. TODD DICKINSON

*Attesting Officer*

*Director of Patents and Trademarks*